US005191697A

United States Patent [19]

Sakamoto et al.

[11] Patent Number: 5,191,697

[45] Date of Patent: Mar. 9, 1993

[54] LOUDSPEAKER DAMPER AND METHOD OF MANUFACTURING THE SAME

[75] Inventors: Yoshio Sakamoto, Hachioji; Akihiko Haga, Shinjo, both of Japan

[73] Assignees: Kabushiki Kaisha Kenwood, Tokyo; Mogami Denki Kabushiki Kaisha, Yamagata, all of Japan

[21] Appl. No.: 770,861

[22] Filed: Oct. 4, 1991

[30] Foreign Application Priority Data

Oct. 5, 1990 [JP] Japan ..... 2-267872

[51] Int. Cl.[5] ..... H04R 31/00

[52] U.S. Cl. ..... 29/594; 264/103; 264/104

[58] Field of Search ..... 228/120, 179, 248, 254; 264/103, 104; 29/609.1, 594

[56] References Cited

U.S. PATENT DOCUMENTS 4,268,810 5/1981 Iwasa et al. ..... 264/103 X 5,111,510 5/1992 Mitobe ..... 29/609.1 X

FOREIGN PATENT DOCUMENTS 55796 4/1985 Japan ..... 264/104

*Primary Examiner*—Kenneth J. Ramsey

*Attorney, Agent, or Firm*—Sixbey, Friedman, Leedom & Ferguson

[57] ABSTRACT

There is provided a method of manufacturing a loudspeaker damper having the steps of attaching a conductive material to a damper raw material at the top or bottom surface thereof, the damper raw material being made of a woven or unwoven cloth impregnated with thermosetting resin such as phenol resin and being made in a semi-dry state, and thermally molding the damper raw material with the conductive material to form concentric corrugation along which conductive material used as a conductive wire for a voice signal is formed, wherein the method further including the steps of: after attaching the conductive material to the damper raw material, coating creamy solder to the conductive material at a predetermined area, melting the creamy solder by the heat at the thermal molding step, detaching the damper raw material from a metal mold to cool and harden the creamy sodler, and forming preparatory solder at the end portion of the conductive material.

5 Claims, 3 Drawing Sheets

LOUDSPEAKER DAMPER AND METHOD OF MANUFACTURING THE SAME

BACKGROUND OF THE INVENTION

1. Field of the Invention

The present invention relates to a loudspeaker damper and a method of manufacturing the same. More particularly, the present invention relates to a loudspeaker damper formed with concentric corrugation on which conductive members are attached, and a method of manufacturing such a loudspeaker damper.

2. Description of the Related Art

A conventional loudspeaker damper is generally manufactured by impregnating thermosetting resin such as phenol resin into a damper raw material such as a woven cloth and unwoven cloth, and thermally molding the damper raw material to provide concentric corrugation.

There is known a loudspeaker damper formed with concentric corrugation on which voice signal input conductive members are mounted in order to reduce man power at a wiring process. Conventional methods of manufacturing loudspeaker dampers with conductive members being attached are mainly classified into the following two types.

(1) A damper raw material such as a woven cloth and unwoven cloth is attached with a conductive material by coupling means or through galvanization of the material. Thermosetting resin such as phenol resin diluted by solvent is then impregnated within the damper raw material. The solvent is thereafter volatilized to remove resin tack. Lastly, the damper raw material is thermally molded.

(2) A desired number of conductive wires such as copper wires are interleaved in a woven cloth at a desired width. Thermosetting resin such as phenol resin diluted by solvent is then impregnated within the woven cloth. The solvent is thereafter volatilized to remove resin tack. Lastly, the damper raw material is thermally molded.

With the above-described conventional methods, a conductive material is attached to a damper raw material or a copper wire is interleaved in a woven cloth, to provide conductive members, and thereafter phenol resin is impregnated. The damper raw material or woven cloth is thermally molded with the phenol resin being attached to the conductive material or copper wire. Therefore, the phenol resin attached to the conductive material or copper wire is also thermally set, forming an excellent and hard insulating layer on the conductive material or copper wire.

The thermally set insulating layer of phenol resin on the conductive material or copper wire is required to be removed at the time of assembling a loudspeaker unit for the connection to lead wires of a voice coil and to input terminals. This removal process increases the number of assembly processes.

A process of removing the phenol resin before thermal setting or a masking process for preventing phenol resin from attaching to a conductive material, also increases the number of assembly processes.

Loudspeaker dampers with conductive members being attached are not presently used in practice although they aim at man power reduction and low cost for a wiring process, because the above-described problem leads to a total high manufacturing cost.

In order to solve the above problem, the present inventors have proposed a loudspeaker damper and method of manufacturing the same wherein a damper raw material such as a woven cloth or unwoven cloth impregnated with thermosetting resin such as phenol resin is made in a semi-dry state, attached with a conductive material made of such as tinsel wire at the top or bottom surface thereof, and thermally molded. The present invention has improved such a loudspeaker damper and method.

SUMMARY OF THE INVENTION

It is an object of the present invention to provide a loudspeaker damper and method of manufacturing the same, capable of not only solving the above problem but also attaching preparatory solder to the end portions of the conductive material which has been impossible by a conventional manufacturing method, allowing an efficient wiring work for connection of the end portions of the conductive material to a voice coil and input terminals, and allowing an improved and stabilized quality and good productivity.

In order to achieve the above object of the present invention, there is provided a method of manufacturing a loudspeaker damper having the steps of attaching a conductive material to a damper raw material at the top or bottom surface thereof, the damper raw material being made of a woven or unwoven cloth impregnated with thermosetting resin such as phenol resin and being made in a semi-dry state, and thermally molding the damper raw material with the conductive material to form concentric corrugation along which the conductive material used as a conductive wire for a voice signal is formed, wherein the method comprising the steps of: after attaching the conductive material to the damper raw material, coating creamy solder to the conductive material at a predetermined area, melting the creamy solder by the heat at the thermal molding step, detaching the damper raw material from a metal mold to cool and harden the creamy solder, and forming preparatory solder at the end portion of the conductive material.

In such a case, the damper raw material may be formed in a stripe, two tinsel wires as the conductive material may be sewed to the damper raw material in the longitudinal direction of the stripe, and the damper raw material are punched out in a predetermined shape after thermal molding and attaching the creamy solder. In this manner, it is possible to mass-produce uniform and reliable loudspeaker dampers.

In the loudspeaker damper with the conductive material attached thereto, preparatory solder is formed and attached to the end portion of the conductive material. It is therefore possible to efficiently connect to conductive material to input terminals or the like, and to improve the quality of the damper.

A damper raw material such as a woven cloth or unwoven cloth formed in a stripe is impregnated with thermosetting resin such as phenol resin. The damper raw material is then made in a semi-dry state to such extent that the resin tack is eliminated. Two tinsel wires are sewed in parallel on the top or bottom surface of the damper raw material at the central area thereof in the longitudinal direction, to thereby form conductive wires. In this case, it is preferably to use the tinsel wire knit in flat so as to make the damper thin and make easy the sewing operation.

Then, using a silk screen printing technique, creamy solder is coated on the damper raw material at the end portion of the conductive material.

The damper raw material is then thermally molded to form concentric corrugation with the conductive material (tinsel wires) being attached thereto. During this thermal molding, the creamy solder is melted, and after the damper raw material is detached from the metal mode, it is cooled and hardened to form preparatory solder.

The damper raw material is then punched out to provide necessary portions of a loudspeaker damper having preparatory solder at the end portion of the conductive material. It is therefore possible to mass-produce uniform dampers. The conductive material is not attached with phenol resin and the preparatory solder is formed at the end portion thereof. Therefore, the wiring operation for connection to a voice coil and input terminals in assembling in assembling it into a loudspeaker unit becomes very easy while considerably reducing cost.

BRIEF DESCRIPTION OF THE DRAWINGS

FIGS. 1 to 6 illustrate an embodiment of the present invention, wherein:

FIG. 1 illustrates a process of impregnating phenol resin;

FIG. 2 illustrates a process of sewing the conductive material to a woven cloth;

FIG. 3 is a plan view showing the area where creamy solder is coated;

FIG. 4 illustrates a thermal molding process;

FIG. 5 is an enlarged cross section showing a manufactured damper; and

FIG. 6 is a plan view of the manufactured damper.

FIGS. 7 to 9 show another embodiment of the present invention, wherein;

FIG. 7 illustrates a process of impregnating phenol resin;

FIG. 8 is a plan view showing a woven cloth into which a conductive material is interleaved; and FIG. 9 shows the enlarged plan view and cross section of the woven cloth shown in FIG. 8.

DETAILED DESCRIPTION OF THE EMBODIMENTS

Preferred embodiments of the present invention will be described with reference to FIGS. 1 to 9.

Figure 1:
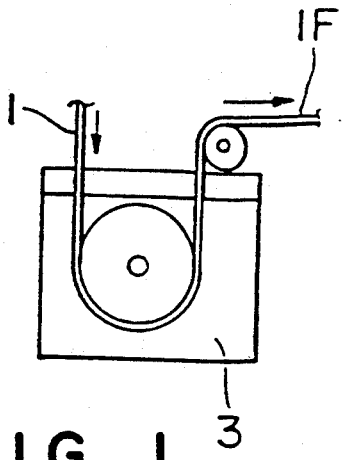

In the embodiment shown in FIGS. 1 to 6, as shown in FIG. 1, a woven cloth 1 formed in a stripe is immersed in a dip tank containing thermosetting resin 3 such as phenol resin diluted with solvent. The woven cloth 1 is therefore impregnated with the thermosetting resin 3, in the manner as conventional. Thereafter, the solvent is volatilized to remove resin tack and form a damper raw material 1F in a semi-dry state.

As a conductive material, a flat knitted tinsel wire 2H is used. The flat knitted tinsel wire 2H is produced in the following manner. A copper foil having a width of about 0.3 mm and a thickness of about 0.02 mm is wound on a central thread made of two twisted meta-based alamid fibers to forma tinsel wire. Thirteen tinsel wires are knitted into the flat knitted tinsel wire 2H which is about 3 mm in width and about 0.6 mm in thickness.

Figure 2:
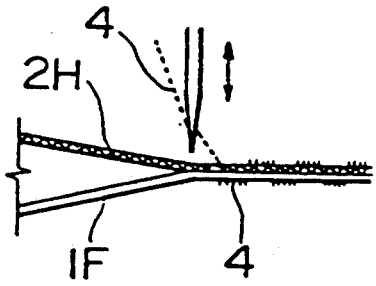
Figure 3:
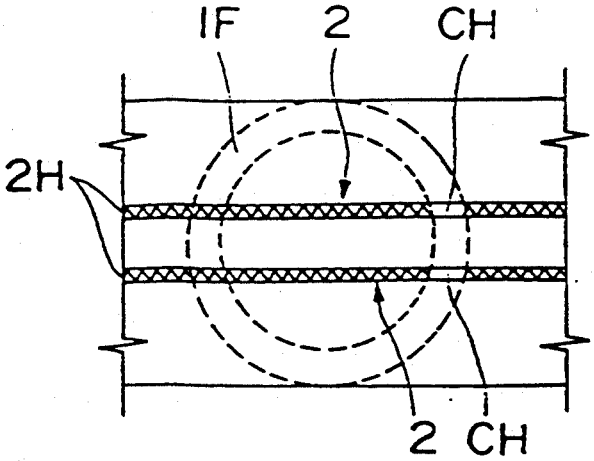
Figure 4:
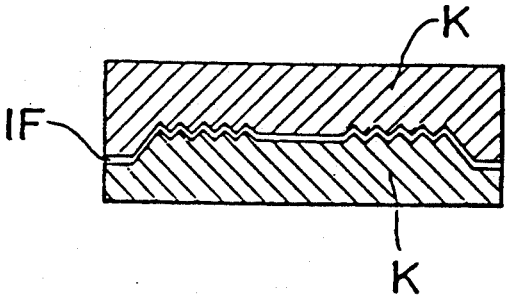
Figure 5:
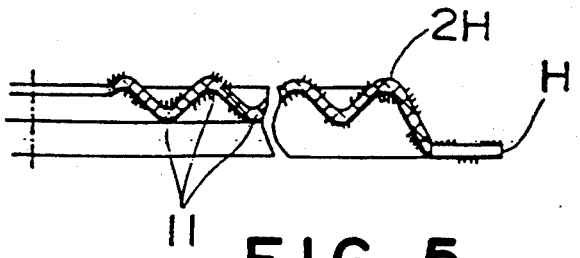

As shown in FIGS. 2 and 3, two flat knitted tinsel wires 2H are sewed in parallel to the damper raw material 1F of a semi-dry state along the longitudinal direction at the center portion thereof. As a sewing yarn 4, a meta-based alamid yarn is used with the sewing width being about 1 mm.

In the above manner, the tinsel wires 2H can be attached without applying the phenol resin on the surface thereof. Since the sewing process can be easily carried out using an industrial sewing machine, a continuous manufacturing operation is possible.

As shown in FIG. 3, after attaching the flat knit tinsel wires 2H, creamy solder CH is coated over predetermined areas of the tinsel wires 2H by a predetermined amount, using a silk screen printing technique. In FIG. 3, the creamy solder CH is coated on the wires 2H at the peripheral end portion of a finished damper. Obviously, the solder may be coated over the portion inner in the radial direction, if desired.

The method of coating creamy solder CH using the silk screen printing technique is well known and widely used in the field of coating solder on printed circuit boards. This method allows to uniformly and easily coat a desired pattern of solder within a desired area at high precision. In this embodiment, although the silk screen technique is used, another method may be used whereby creamy solder contained in a syringe is ejected out using compressed air.

After the above processes, the woven cloth 1F is thermally molded and maintained under pressure for about 10 seconds, by using a damper metal mold K which is heated about 250° C. This damper metal mold K is formed with cut portions so as to make the woven cloth F have concentric corrugation 11. During thermal molding, the thermosetting resin 3 is set so that the flat knitted tinsel wires 2H molded on the concentric corrugation 11 are also held in position. At the same time, the creamy solder CH melts and attaches to the flat knitted tinsel wires 2H. When the woven cloth F is detached from the metal mold K, the creamy solder CH is rapidly cooled and hardened so that a preparatory solder H is formed and fixedly attached to the tinsel wires 2H.

Figure 6:
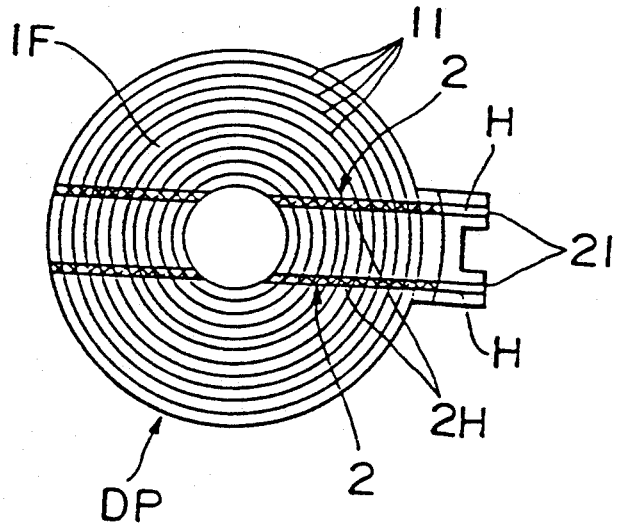

The molded woven cloth F is then subject to a punch-out process to trim unnecessary portions. By this punch-out process, there are provided an inner hole into which a voice bobbin is inserted, a damper mounting marginal portion, and the like, so that a damper DP with the conductive wires 2 being attached as shown in FIG. 6 can be obtained. The end portion of the conductive wires 2 of the damper DP has the preparatory solder H being fixedly attached thereto. In the above embodiment, the flat knit tinsel wires 2H are used as the conductive material. It is also possible to use a tinsel wire knitted in an ordinary cord shape.

Figure 7:
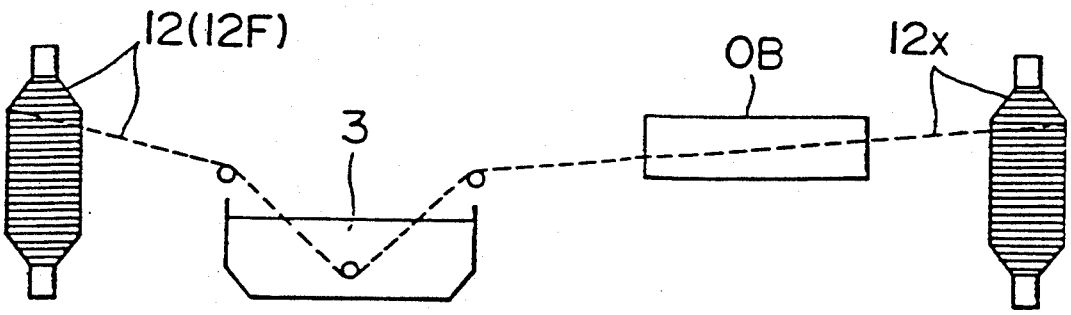
Figure 8:
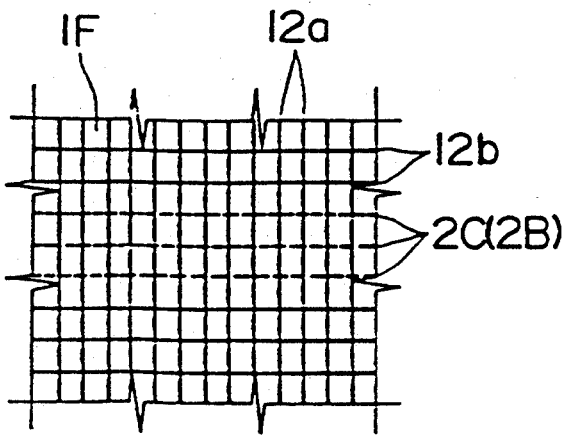
Figure 9:
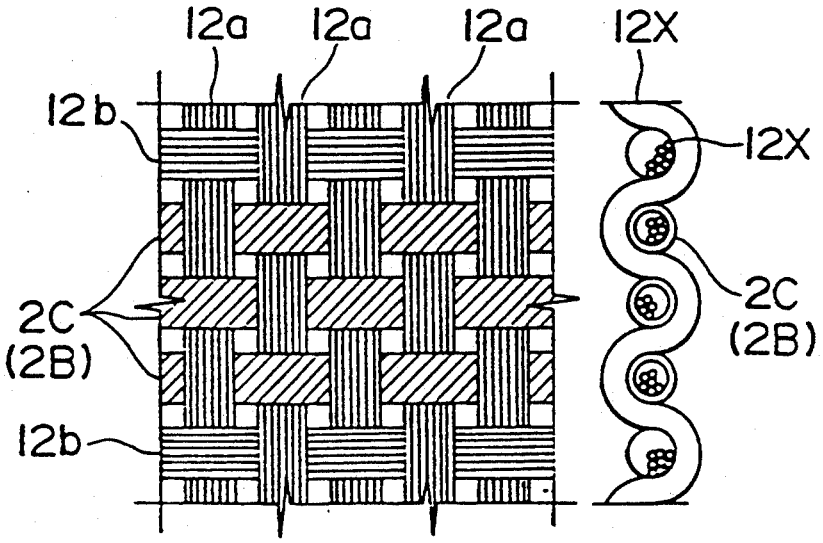

Another embodiment will be described with reference to FIGS. 7 to 9.

In this embodiment, a yarn 12 constituting a woven cloth 1 or a fiber 12F constituting the yarn 12 is impregnated with thermosetting resin 3 such as phenol resin diluted by solvent, and thereafter passed through a dry furnace OB to volatilize the solvent and remove resin tack. The finished yarn 12x is used to produce the woven cloth 1F. A predetermined number of copper wires 2C or tinsel wires 2B are interleaved into the woven cloth at predetermined positions as its warp **12*a* or weft 12*b*, the copper wires 2C or tinsel wires 2B** being used as the conductive wires.

In this manner, it is possible to produce the woven cloth with the tensile wires 2B on which thermosetting resin 3 is not coated. The process of coating creamy solder and thermal molding are carried out in the similar manner as of the first embodiment.

According to the method of manufacturing a loudspeaker damper of the present invention, phenol resin or the like is not attached to the conductive material mounted on the woven cloth. It is therefore possible to mount preparatory solder on the end portion of the conductive material. The creamy solder used as preparatory solder is melted by the heat of the metal mold which molds the damper, and after the woven cloth is detached from the metal mold, it is cooled and made hard. It is thus possible to easily attach preparatory solder and harden it.

According to the conventional method, preparatory solder is attached before thermal molding by using ordinary rod type solder and a soldering iron. Therefore, thermosetting resin is locally set, thus hindering proper molding of the damper. Furthermore, if preparatory solder is to be attached to the damper after being molded, the number of processed increases. Even if creamy solder is used for the damper after being molded, silk screen printing is difficult to be carried out for the molded damper with corrugation, so the creamy solder cannot be coated reliably to the predetermined area.

According to the method of the present invention, preparatory solder can be reliably attached while retaining a uniformly finished surface. This process is very simple and suitable for continuous manufacturing, allowing automatic manufacturing.

According to the present invention, in the loudspeaker damper with conductive members being attached, preparatory solder is formed at the end portion of the conductive members made of tinsel wires. Therefore, a wiring operation for the connection to a voice coil, and input terminals is easy, and loose ends of the tinsel wire can be avoided, thereby considerably reducing the manufacturing cost.

What is claimed is:

1. A method of manufacturing a loudspeaker damper having the steps of varnishing a woven cloth with thermosetting resin and drying the varnished woven cloth into a semi-dry state, attaching a conductive material to the surface of the varnished woven cloth in a semi-dry state and thermally molding the woven cloth with the conductive material to form concentric corrugation along which the conductive material used as a conductive wire for a voice signal is formed, wherein said method comprising the step of:

after attaching said conductive material to said varnished woven cloth in a semi-dry state, coating creamy solder to said conductive material at a predetermined area, melting said creamy solder by the heat at said thermal molding step to form preparatory solder at the end portion of said conductive material.

2. A method of manufacturing a loudspeaker damper according to claim 2, wherein said conductive material is sewed to said varnished woven cloth, in a semi-dry state.

3. A method of manufacturing a loudspeaker damper comprising the steps of:

varnishing a yarn or thread with thermosetting resin and drying the varnished yarn or thread in a semi-dry state;

weaving the varnished yarn or thread in a semi-dry state into a cloth with interleaving a conductive wire for a predetermined area in the woven cloth; and molding the woven cloth having the interleaved conductive wire and hardening the thermosetting resin in a predetermined temperature to shape the woven cloth into a corrugated damper.

4. A method according to claim 3 further comprising the step of coating a portion of the conductive wire interleaved area in the woven cloth with a creamy solder, before taking said molding step.

5. A method according to claim 3, wherein said conductive wire is tinsel wire.

* * * * *